US007789967B2

(12) United States Patent
Classen et al.

(10) Patent No.: US 7,789,967 B2
(45) Date of Patent: Sep. 7, 2010

(54) DISHWASHING MACHINE HAVING A DOSING DEVICE FOR ADDITIVES AND ASSOCIATED METHOD

(75) Inventors: Egbert Classen, Wertingen (DE); Helmut Jerg, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 926 days.

(21) Appl. No.: 10/582,246

(22) PCT Filed: Dec. 8, 2004

(86) PCT No.: PCT/EP2004/053343

§ 371 (c)(1),
(2), (4) Date: Jun. 9, 2006

(87) PCT Pub. No.: WO2005/058126

PCT Pub. Date: Jun. 30, 2005

(65) Prior Publication Data

US 2007/0144558 A1 Jun. 28, 2007

(30) Foreign Application Priority Data

Dec. 16, 2003 (DE) ..... 103 58 969

(51) Int. Cl.
*B08B 3/04* (2006.01)
*B08B 3/08* (2006.01)
*B08B 7/04* (2006.01)

(52) U.S. Cl. ..... 134/18; 134/25.2; 134/26; 134/29; 134/56 D

(58) Field of Classification Search ..... 134/18, 134/25.2, 26, 29, 56 D
See application file for complete search history.

(56) References Cited

U.S. PATENT DOCUMENTS 3,756,457 A * 9/1973 Holmes et al. ..... 222/1

(Continued)

FOREIGN PATENT DOCUMENTS

DE 32 37 785 9/1983

(Continued)

OTHER PUBLICATIONS

International Search Report PCT/EP2004/053343, Jun. 30, 2005.

*Primary Examiner*—Michael Kornakov
*Assistant Examiner*—Natasha Campbell
(74) *Attorney, Agent, or Firm*—James E. Howard; Andre Pallapies

(57) ABSTRACT

A dish washing machine is provided having a dosing device operable to add an additive product into the dishwasher, the dosing device being operatively connected to an arrangement that separately stores the basic chemical products of an all-round additive product independent of one another. The dosing device is operable to independently add into the dishwasher one basic chemical product not used for clear rinsing of the all-round additive product, at least two, but not all, of the basic chemical products of the all-round additive product together, or at least one reaction mixture consisting of the basic chemical products of the all-round additive product.

15 Claims, 2 Drawing Sheets

U.S. PATENT DOCUMENTS

Figure 1:
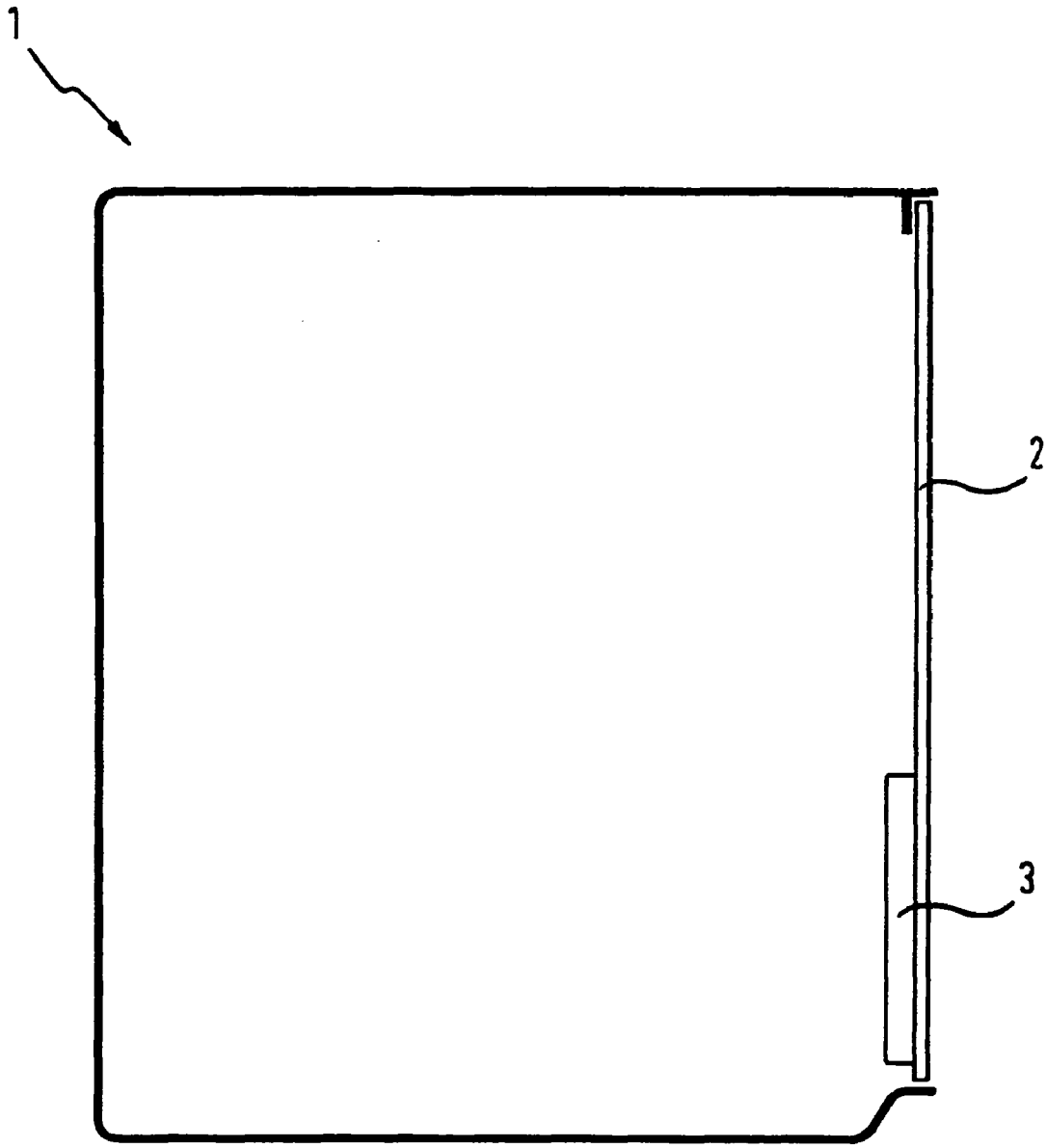

| | | | | |
|---|---|---|---|---|
| 3,888,269 | A * | 6/1975 | Bashark | 134/57 D |
| 4,110,075 | A | 8/1978 | Graf et al. | |
| 4,188,807 | A * | 2/1980 | Graf et al. | 68/17 R |
| 5,453,131 | A * | 9/1995 | Chan et al. | 134/18 |
| 5,839,454 | A * | 11/1998 | Matz | 134/57 D |
| 6,035,472 | A | 3/2000 | Barbe | |
| 2002/0117511 | A1* | 8/2002 | McNabb et al. | 221/197 |
| 2003/0127110 | A1* | 7/2003 | Reichold et al. | 134/18 |

FOREIGN PATENT DOCUMENTS

| | | |
|---|---|---|
| DE | 38 12 109 | 10/1989 |
| DE | 40 18 582 | 12/1991 |
| DE | 195 11 789 | 10/1995 |
| DE | 100 10 194 | 9/2001 |
| EP | 0 048 519 | 3/1982 |
| EP | 0 392 196 | 10/1990 |
| EP | 1 186 694 | 3/2002 |
| GB | 2 288 191 | 10/1995 |
| JP | 63 318997 | 12/1988 |
| WO | WO 02/058528 | 8/2002 |

* cited by examiner

DISHWASHING MACHINE HAVING A DOSING DEVICE FOR ADDITIVES AND ASSOCIATED METHOD

The invention relates to a dishwashing machine having a dosing device for the addition of additives to the washing container and a method for dosing additives into the washing container in a dishwashing machine.

Additives are required for all process or program steps, especially for the "cleaning" process step, in dishwashing machines, these additives comprising cleaning, washing, care, decalcifying and clear rinsing agents as well as supplementary additives such as active chlorine or bleach. The additives are generally supplied as solids in the form of free-flowing powders, powders compressed to form tabs, gels or liquids. The quantities of additives required in each case must be added before the beginning of the cleaning cycle, apart from rinse aids for example, generally manually by the user, the fractions of the individual agents being fixedly predefined without regard to the actual requirement. Only the clear rinsing aid is stored in highly diluted form in storage containers for a plurality of applications and is added automatically by means of a dosing device, if no combination product with integrated clear rinsing fraction is used.

A detergent feeding device for household appliances is known from DE 3812109 A1. A powder or liquid detergent is stored in one chamber and a clear rinse agent in another chamber. The additives are supplied automatically to the cleaning process by means of a pump.

Known from GB 2288191 A is an automatic dosing system for detergent or softeners in washing and dishwashing machines comprising a refillable container for concentrated detergent and softener.

Known from DE 4018582 A1 is a device for metering proportional quantities of additives to liquid detergents in an industrial dishwashing machine. Liquid detergent is conveyed into the washing tank by a metering pump via a supply pipe. Directly in front of the opening of the supply pipe into the washing tank is an injection nozzle in the fashion of a jet pump with a suction pipe to at least one storage vessel for liquid additives, e.g. hydrogen peroxide ($H_2O_2$), active chlorine or anti-foaming agent. Since both components, namely detergent and additive, are only brought together directly before entry into the washing process and the mode of action befitting thereto can then evolve directly in the washing process in the washing tank, no time remains for a chemical reaction. A disadvantage here is that the additive can only be metered to a limited extent depending on the quantity of detergent added and thus is not possible independently. Furthermore, only liquid additives can be added.

Known from DE 3237785 A1 of the applicant is a device for individual metered conveyance of a plurality of pumpable active substances. The pumpable active substances are conveyed from a respective supply container into a common working container and for mixing the conveyed active substances with a working medium whereby the supply container and a working-medium intake line can be connected via individually controllable valves to a collecting channel, the connecting outlet of which can be connected to the working container via a pumping closing in an air-tight manner. A disadvantage of this device is that as a result of using a common working container, residue of active substances can react with other active substances so that undesirable chemical reactions can occur. Thus, active substances cannot be metered independently and cleanly into a treatment chamber.

Known from DE 2554592, in which the applicant was involved, is a washing process for textiles which is carried out in an automatic washing machine. In this case, active substances or combinations of active substances provided separately in the washing process are supplied in pumpable form to the washing solution in the washing machine in a metered manner before or during the washing process, the active substances or combinations of active substances being active washing substances, structural substances, optionally stabilised bleaching agents, optionally a catalyst which accelerates the bleaching process, optionally an organic acid, and optionally a fabric softener. In this case, a specific bulk of active washing substances and structural substances per litre of washing solution is necessarily prescribed. In the working means for the washing process the active substances concerned are provided separately in containers suitable for domestic use. In a device for carrying out the process, a number of dosing devices corresponding to the number of active substances or active substance combinations used are accommodated inside the machine housing of the washing machine, their intakes being connected directly to an intake connection of an allocated active substance container. Thus, only the active substances accommodated in the containers can be added to the washing solution.

A disadvantage here is that the process, the working means and the device can only be used in a washing machine because a different basic technical concept is provided which cannot be used in dishwashing machines, especially as a result of using substantially only active washing substances and structural substances because the other substances are not generally required in dishwashing machines, and as a result of the design configuration of the device. Furthermore, the method is predominantly directed towards allowing matching to specific water hardness or proportions of bleaching agents. Consequently, it is not possible to adapt especially to specific cases of contamination. In addition, the active substances which can be added are restricted to active washing substances, structural substances, stabilised bleaching agents, catalysts which accelerate the bleaching process, organic acids and fabric softeners so that the method can only be used in a restricted manner for applications requiring these active substances.

The additives for dishwashing machines used in the prior art, especially detergents, consist of a mixture of different substances or basic chemical products (components) having different in each case, special tasks. The additives used hitherto, whether added manually or automatically, are "all-round products" or "combination products" which are designed for a very broad spectrum of applications. It is therefore not possible to make a specific selection of different substances or basic chemical products (components) required for one application or process step, e.g. for the "cleaning" program step because enough additive must be added until the portion of the substance or basic chemical product (component) required for every feasible domestic application is achieved.

For example, the detergents used in the prior art as compact cleaning agents for dishwashers consist of the following basic chemical products or components as additives: non-ionic tensides (wetting agents), phosphates (builders), soda and silicates (alkali carriers), perborate and TAED (bleaching agent), amylase and protease (enzymes) as well as anti-foaming agents, softeners, fragrances, dyes, disintegrants and coatings/binders (adjuvants which are not directly involved in the cleaning process). However, only builders and alkali carriers are required for the removal of, for example, vegetable fat from the dishes in the "cleaning" program step in a dishwashing machine. All the other components are disadvantageously not required in this program step, i.e., they are added without actually being necessary.

Thus, a disadvantageous quantitative over-dosing is usually necessary when the "all-round product", e.g. as an all-round cleaning agent, is added both manually and automatically in order to ensure the minimum quantity of the basic chemical products or components required for the specific case of contamination. Other components or basic chemical products of the additive are involved little or not at all in the cleaning process. These disadvantageously pollute the environment to a considerable extent on account of the large number of dishwashing machines and their frequent use. Furthermore, high costs are thereby incurred for the user of dishwashing machines to acquire basic chemicals or components in the additives which are used unnecessarily.

In addition, a liquid clear rinse agent is generally used in dishwashing machines, which consists of about 97 vol. % of water as a result of the required dosing accuracy and only 3 vol. % is effectively active as a clear rinse agent in order to achieve a higher dosing accuracy because harmful excess foaming of the dishwasher occurs in the event of overdosing.

It is thus the object of the present invention to provide a dishwashing machine and a method whereby only the basic chemical products required for particular needs, especially basic chemical products of all-round products, need be added to the washing container.

This object is achieved by the dishwashing machine according to the invention and the method according to the invention as set forth herein. Further developments of the invention are are also set forth herein.

In the dishwashing machine having a dosing device for the addition of additives, e.g. in a washing container, it is provided according to the invention that at least one basic chemical product not used for clear rinsing and/or at least two basic chemical products together, but not all the basic chemical products of an all-round product together, and/or at least one reaction mixture consisting of basic chemical products can be added independently.

Preferably at least a portion of the basic chemicals of an all-round product can be added.

The reaction mixture, e.g. a liquid or a gas, can appropriately be produced in the dosing device in a micro-reactor at least in part by a chemical reaction. In this way, unstable additives produced from stable basic chemical products can advantageously be added in a dishwashing machine and furthermore, gaseous additives can also be easily used for the cleaning process.

Advantageously, only those basic chemical products or reaction mixtures which are required for a process step, e.g. for cleaning, are added. By this means, only the required basic chemical products are advantageously added in the required quantity and at the correct time.

The basic chemical products are preferably stored in refillable or exchangeable storage containers which are preferably constructed in the form of a common housing with partition walls or in individual separate units.

In a further embodiment of the present invention, the basic chemical products are a liquid, a gel or a powdery/granular solid, especially as concentrate.

According to a further advantageous embodiment of the present invention, the basic chemical products can be supplied to the micro-reactor and/or the washing container using a conveying device, especially a micro-dosing pump, e.g. a flexible tube pump or gear pump.

Advantageously, the addition parameters, time and quantity of the basic chemical products or the reaction mixture for a process step can be regulated depending on the process steps and/or the actual contamination which is detected automatically using sensors or manually. Thus, the components or basic chemical products can be optimally dosed because specific dosing according to time and quantity is possible. The basic chemical products are thus added at the respectively optimal time within the process step and the respectively optimal quantity is added. As a result of the possibility of detecting the actual contamination, the addition parameters can be further optimised for the application.

The supply of the basic chemical products or the reaction mixture can preferably be regulated by means of a monitoring device and in the event of a fault, a visual and/or audible fault indication can be made, wherein an automatic program interruption is preferably possible. This monitoring device can eliminate errors in process steps as a result of too little or no addition of basic chemical products or reaction mixtures. The visual and audible fault indication allows the user of the dishwashing machine to actively intervene and eliminate the fault.

In a further preferred embodiment of the present invention, the filling level in the storage containers can be measured by level sensors and can be displayed visually by a display device and preferably, if the level is too low, a visual and/or audible warning can be given. This allows the user to comfortably read off the level in the storage containers and if necessary, refill the basic chemical products or exchange the storage containers.

In a further preferred embodiment of the present invention, in a dishwashing machine with an internet connection, the filling level of the storage containers can be automatically notified to a dispatch device and if required, after a request of the user or automatically, basic chemical products dispatched as exchangeable storage containers or as storage packs for refilling the storage containers. This can considerably enhance the comfort for the user because unlike in the prior art, the user no longer needs to look after the additives independently but these are sent automatically to the household. As a result of the low consumption of additives because of the optimised dosage and separation of the components and the use of concentrates, very low costs are incurred because dispatches are only required at relatively greater time intervals, for example, only every three to four months.

In a method for dosing additives according to the invention, e.g. in the washing container in a dishwashing machine, at least one basic chemical product not used for clear rinsing and/or at least two basic chemical products together, but not all the basic chemical products of an all-round product together, and/or at least one reaction mixture consisting of basic chemical products can be added independently. All-round products with many components are generally used in the prior art so that the addition of components which are not required cannot be avoided.

Preferably, at least a portion of the basic chemical products of an all-round product is added.

In a further embodiment of the present invention, only those basic chemical products or reaction mixtures which are required for a process step, e.g. for cleaning, are added using a conveying device, e.g. a micro-pump.

According to an advantageous embodiment, basic chemical products react in a micro-reactor at least partly by a chemical reaction to form a, for example, liquid or gaseous reaction mixture. This also makes it possible to add unstable reaction mixtures which cannot normally be stored for a fairly long period or lose their efficiency through storage. Furthermore, as a result it is also possible to supply gaseous reaction mixtures, which otherwise, for example, active chlorine can only be provided as additives for dosing in a dishwashing machine with great difficulty.

In a further embodiment of the present invention, the basic chemical products are supplied to the micro-reactor and/or the washing container in a precisely metered manner by a micro-dosing pump.

Advantageously, the addition parameters, time and quantity of the basic chemical products or the reaction mixture (R) for a process step can be regulated depending on the process steps and/or the actual contamination which is detected automatically using sensors or manually.

Figure 2:
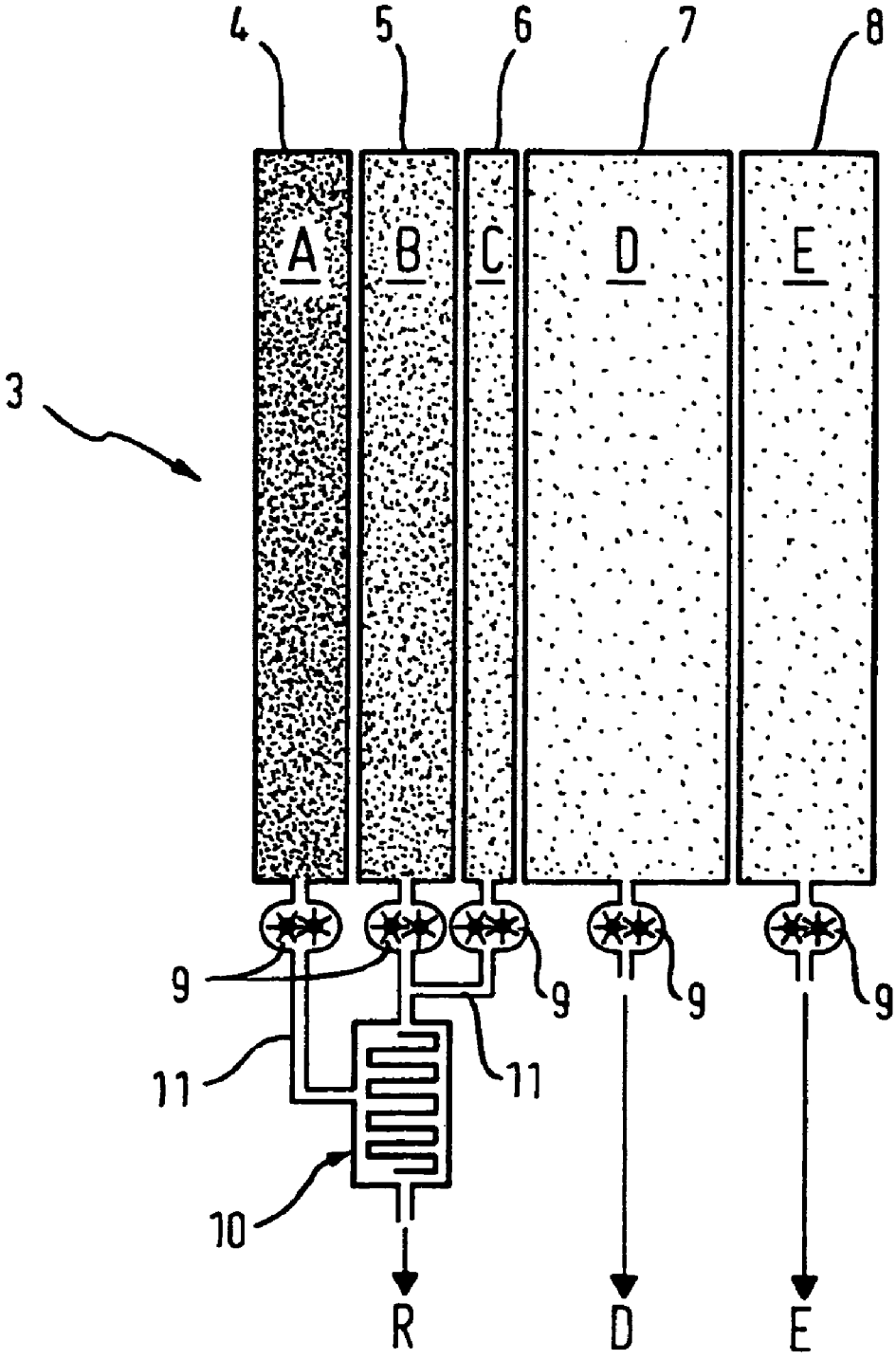

The present invention is explained in detail with reference to an exemplary embodiment. In the figures:

FIG. 1 is a schematic sectional view through a washing container of a dishwashing machine according to the invention with a dosing device in a door and FIG. 2 is a schematic view of a dosing device according to the invention.

FIG. 1 is a schematic section view through a washing container 1 of a dishwashing machine according to the invention. The washing container 1 is closed by a door 2. Located in the washing container 1 is the crockery to be cleaned in crockery baskets (not shown). A dosing device 3 is preferably arranged in the door 2. The dosing device 3 can be located at any other point on the washing container 1, e.g. on the side walls of the washing container 1.

FIG. 2 shows a schematic view of the dosing device 3 according to the invention. The additives, e.g. detergent and clear rinse aid, for this dishwashing machine according to the invention are not accommodated as a combination product in respectively one storage container but the individual components or basic chemical products A, B, C, D, E are accommodated separately in separate storage containers 4, 5, 6, 7, 8. The components or basic chemical products D, E are preferably parts of a combination product and are used for cleaning, for example, and are supplied directly to the washing process. The basic chemical products A, B, C are starting substances for producing the reaction mixture R.

The storage containers 4, 5, 6, 7, 8 can be executed in the form of a common housing with subdivisions e.g. in the form of partition walls, for the individual components or basic chemical products A, B, C, D, E with or without an integrated micro-dosing pump 9 (not shown). Alternatively, separate, individual storage containers 4, 5, 6, 7, 8 can be constructed with and without an integrated micro-dosing pump 9 (not shown). Furthermore, a combination of these two embodiments is also possible, The components or basic chemical products A, B, C, D, E are either refilled in the storage containers 4, 5, 6, 7, 8 or exchangeable storage containers 4, 5, 6, 7, 8 are used, these being replaced full storage containers 4, 5, 6, 7, 8 after emptying (not shown). In the case of exchangeable storage containers 4, 5, 6, 7, 8, the fixing of storage containers 4, 5, 6, 7, 8 in the wrong slot can be eliminated preferably by applying a readable code or by different plug devices for each individual storage container 4, 5, 6, 7, 8. Furthermore, by means of corresponding signal devices, e.g. colours or symbols, on the storage containers 4, 5, 6, 7, 8 and on the slot, the user can be guided to insert the storage container at the correct slot. In FIG. 2 the different width of the storage containers 4, 5, 6, 7, 8 symbolises the different required quantity for the components A, B, C, D, E and the different capacities of the storage containers 4, 5, 6, 7, 8.

It is also possible to store a plurality of basic chemical products A, B, C, D, E, for example, two basic chemicals E, F (not shown) in one or more storage containers 4, 5, 6, 7, 8, e.g. storage container 8, where preferably one storage container 8 contains basic chemical products E, F for specific cases of contamination, e.g. a particularly high proportion of fat, carbohydrate or dried-in contamination. Then, a portion of the basic chemical products D, E of an all-round product, i.e. one or more basic chemical products A, B, C, D, E but not all the basic chemical products of an all-round product, can be supplied to the cleaning process from one storage container 7, 8 independently of the addition of the other basic chemical products and automatically. Thus, at least one basic chemical products D, E or a plurality of basic chemical products F, G (not shown) can be supplied jointly. Basic chemical products A, B, C, D, E are also to be understood as substances which are not contained in all-round products.

The basic chemical products A, B, C, D, E, e.g. as concentrates, are preferably a liquid but can also be a gel or a powder/granular solid. Additives which are not decomposed into components, e.g. clear rinse aid can also be stored in the storage containers 4, 5, 6, 7, 8. The components A, B, C, D, E are supplied to the cleaning process in a precisely dosed manner by means of conveying devices 9. The conveying devices 9 are preferably embodied as micro-dosing pumps, e.g. as flexible-tube or gear pumps, for liquids or as dosing devices for powder or granules. Separate dosing devices 9 could also be dispensed with if, in an embodiment not shown, the components or basic chemical products A, B, C, D, E are dosed by means of gravity and special outlet valves. The components D, E in the storage containers 7, 8 are supplied directly to the cleaning process in the washing chamber 1 by means of the micro-dosing pumps 9. The components A, B, C in the storage containers 4, 5, 6 are supplied to the micro-reactor 10 by means of the micro-dosing pumps 9 via lines 11. Dosing using the micro-pumps 9 is carried out very precisely as micro-dosing for all components or basic chemical products A, B, C, D, E, especially when using highly concentrated basic chemical products. The micro-reactors 10 are preferably those known in particular, from pharmaceutical and plant chemistry, these known micro-reactors 10 being appropriately adapted for the specific application in dish-washing machines. The design of the micro-reactor 10 is determined by the process parameters, e.g. reaction guidance and reaction quantities. They are easily integrated into dishwashing machines as a result of the extremely small design. The ratio between surface area and volume in the reaction vessels allows rapid and reliable process guidance even with reactive mixtures. As a result of the small dimensions, with reaction vessels the size of pinheads in some cases, the temperature and pressure can be regulated extremely accurately, resulting in a high yield with no undesirable side products or very small amounts thereof in chemical reactions and also allowing multi-stage syntheses. The micro-reactors 10 can, for example, accommodate micro-mixers, heat exchangers, sensors for pressure and analysis and catalysts, especially as a coating of the inner surface of the reaction vessel. A plurality of micro-reactors 10 can also be connected in a row or series with corresponding supplies as lines 11 from the storage containers 4, 5, 6, 7, 8 (not shown). Furthermore, micro-mixing chambers can also be connected in a row or in series, also in combination with micro-reactors, where micro-mixing chambers deliver dispensions.

In the micro-reactor 10 the components or basic chemical products A, B, C react to form the reaction mixture R which is supplied to the cleaning process in the washing chamber 1. In addition to the components A, B, C of an all-round product, the starting substances A, B, C for the reaction in the micro-reactor 10 can also be basic chemical products A, B, C not contained in the all-round product. Water, preferably from the water supply of the dishwashing machine (not shown) can also be supplied to the micro-reactor 10. This is necessary either if water is required for a chemical reaction in the micro-reactor 10 or the micro-reactor is used for merely diluting a concentrate, e.g. a clear rinse aid, a component or basic chemical product A, B, C or for washing out the residual reaction mixture. The reaction mixture R, for example, is an unstable compound which is briefly produced for a short time from the basic chemical products A, B, C using micro-dosing pumps 9 in the micro-reactor 10 as required. On account of the short-term production of the reaction mixture R, long-term stability as in the combination products from the prior art can thereby advantageously be dispensed with. Thus, substances which hitherto have not been available in dishwashers because of their instability can also be supplied to the washing chamber 1. Consequently, substances which hitherto have not been used in dishwashers can also be used. In general, the reaction mixture R is a liquid. However, it is also possible that a gas is released from the micro-reactor 10 as reaction mixture R into the washing chamber, for example, active chlorine. This also has the crucial advantage that gaseous additives can simply be added to the washing chamber in dishwashing machines, because hitherto gases could only be stored in dishwashing machines with very great difficulty. The micro-dosing pumps 9 are controlled automatically by means of appropriate electronics by detecting the reaction parameters in the micro-reactor 10.

As a result of the specific addition of individual components or basic chemical products D, E and the reaction mixture R as additives, only those components or basic chemical products actually required for the adjacent process step, especially for cleaning, e.g. depending on the degree and type of contamination, are supplied to the washing chamber. For example, only components D, E are required for the removal of vegetable fat from crockery so that the addition of other additives in this process step can be dispensed with. As a result, the acquisition costs for additives are significantly reduced for the user of a dishwashing machine because the components or basic chemical products not required are not supplied to this cleaning process and therefore not consumed. In addition, more cost-effective basic chemical products A, B, C, D, E, e.g. originating from large-scale industrial production, can advantageously be used instead of expensive mixed products. Furthermore, no unnecessary basic chemical products D, E and reaction mixtures R enter into the drainage system so that a considerable contribution can be made to environmental protection.

As a result of the specific addition of the components D, E and the reaction mixture R, the process guidance of the cleaning process can be optimised because the addition parameters, time, quantity and type of basic chemical products D, E or reaction mixture R, can be optimally selected. These addition parameters are generally selected depending on the program steps. For example, in the "cleaning" program step, the addition parameters for the components D, E which are required for cleaning for this special process, are optimally selected. If necessary, cleaning process parameters, e.g. the degree of contamination, can additionally be detected by sensors (not shown) in the washing container 1 (FIG. 1) and the addition parameters can be controlled depending thereon. Sensors of this type have not yet been fully researched or have barely been used so far because of their overall size or costs in dishwashing machines. Here, a manual or partly automatic input on the degree and type of contamination can be used as a replacement, as far as a fully automated solution. The cleaning performance and degree of cleaning can thus be considerably improved. In addition, the washing solution can be heated to lower temperatures when using individual basic chemical products in different washing baths so that a considerable energy saving can also be achieved.

The supply of the basic chemical products D, E and the reaction mixture R to the washing chamber and preferably also the supply of the components A, B, C to the micro-reactor 10 is preferably monitoring using a monitoring device (not shown). In the event of a fault, a visual and/or audible fault message is issued and the program is preferably interrupted.

Furthermore, the storage containers 4, 5, 6, 7, 8 have level sensors, e.g. electrical, mechanical or optical, The level is displayed visually on the control panel of the dishwashing machine and there is preferably an audible warning if the level is too low. It is especially advantageous in dishwashing machines which have an internet connection if the level is automatically notified to a dispatch device for basic chemical products A, B, C, D, E. The dispatch device can then send the requisite basic chemical products A, B, C, D, E automatically or after a previous request from the user of the dishwashing machine, e.g. in the form of exchangeable storage containers 4, 5, 6, 7, 8 or as supply packs for refilling the re-fillable storage containers 4, 5, 6, 7, 8. This means a considerable increase in comfort for the user because basic chemical products A, B, C, D, E or additives no longer need to be purchased in shops and transported home but are automatically delivered to the household of the user, e.g. by post.

With the dishwashing machine according to the invention and relevant method, the basic chemical products and/or reaction mixtures required in each case can be specifically added to the washing solution optimised for a process step within the program sequence. The degree of cleaning as well as the cleaning and drying performance is thereby increased and improved. An unnecessary addition as in the prior art using combination products can thereby be avoided. This is associated with a reduction in costs for the user on the one hand as a result of the inexpensive basic chemical products as compared with expensive combination products and on the other hand, as a result of the specific optimised addition of specially selected components or basic chemical products for each process step. Thus, a considerable contribution to the protection of the environment can also be made. On account of the specific addition of basic chemical products and the use of concentrates, the storage containers for the basic chemical products more conveniently only need to be refilled or exchanged at long time intervals, e.g. every three months as compared with the expensive and awkward addition of detergents or additives before every washing or cleaning process in the prior art.

Fragrances, care agents for glass, crockery and cutlery, anti-bacterial chemicals and anti-corrosives to prevent metal and glass corrosion, can be used as basic chemical products to achieve supplementary care or improvement. When binders for water hardness-forming agents are used as basic chemical products, separate softening, e.g. using a softening unit such as an ion exchanger or other method for water softening, can advantageously be dispensed with in the dishwashing machine.

In dishwashing machines with an internet connection, it is in addition of particular advantage that the basic chemical products can be automatically sent by post without the user needing to act. As a result of the relatively long time intervals at which the basic chemical products are refilled, basic chemical products only need to be sent very infrequently and are therefore extremely cost-effective.

REFERENCE LIST

1 Washing container
2 Door
3 Dosing device
4, 5, 6, 7, 8 storage container
9 Conveying device
10 Micro-reactor
11 Line
A, B, C, D, E, F, G components or basic chemical products

The invention claimed is:

1. A dishwashing machine comprising:

a washing container for retaining therein items to be washed; and a dosing device operable to add an additive product into the dishwashing machine, the dosing device being operatively connected to an arrangement that separately stores the basic chemical products of an all-round additive product independent of one another and the dosing device being operable to independently add into the dishwasher: 1) at least a portion of a selected one of at least one basic chemical product of the all-round additive product not used for clear rinsing, 2) at least two, but not all, of the basic chemical products of the all-round additive product together, and 3) at least one reaction mixture including the basic chemical products of the all-round additive product.

2. The dishwashing machine according to claim 1, wherein the dosing device includes a micro-reactor operable to produce a reaction mixture that is a selected one of completely a liquid mixture, completely a gas mixture, and a mixture that is not completely a liquid or a gas, the micro-reactor being operable to produce the reaction mixture at least in part by a chemical reaction.

3. The dishwashing machine according to claim 1, wherein the dosing device is operable to add into the dishwasher only those basic chemical products or reaction mixtures that are required for a process step.

4. The dishwashing machine according to claim 1, wherein the dosing device is operable to add in basic chemical products of an all-round additive product that are stored in at least one of a plurality of refillable storage containers and of a plurality of exchangeable storage containers, wherein the at least one of a plurality of refillable storage containers and of a plurality of exchangeable storage containers are configured in at least one container form including at least one of a common housing with partition walls and individual separate units, and a container form that is not at least one of a common housing with partition walls and individual separate units.

5. The dishwashing machine according to claim 1, wherein the dosing device is operable to add in basic chemical products of an all-round additive product that are one of a liquid, a gel and at least one of a powdery solid and a granular solid, wherein the basic chemical products are formed as one of a concentrate and not a concentrate.

6. The dishwashing machine according to claim 1, wherein the dosing device is operable to add in basic chemical products of an all-round additive product wherein the basic chemical products are supplied to at least one of a micro-reactor and the washing container using a conveying device, wherein the conveying device includes at least one of a micro-dosing pump and a device that is not a micro-dosing pump.

7. The dishwashing machine according to claim 1, wherein the dosing device is operable to add in basic chemical products of an all-round additive product while regulating the addition parameters, time and quantity of the basic chemical products or the reaction mixture for a process step depending on the process steps and/or actual contamination that is detected automatically using sensors or manually.

8. The dishwashing machine according to claim 1, wherein the dosing device is operable to add in basic chemical products of an all-round additive product while regulating the supply of at least one of the basic chemical products a reaction mixture by means of a monitoring device and wherein the dosing device is configured to produce an program interruption in response to at least one of a fault, a visual fault indication and an audible fault indication.

9. The dishwashing machine according to claim 1 and further comprising a plurality of storage containers and a plurality of level sensors for measuring a filling level in the storage containers in which are stored the basic chemical products of an all-round additive product and a fill level value indicator, and a low level alarm for generating at least one of a visual warning and an audible warning if a level is too low.

10. The dishwashing machine according to claim 9 and further comprising an internet connection, means for automatically notifying a dispatch device concerning the filling level of the storage containers and means for dispatching, if required, basic chemical products in at least one of exchangeable storage containers and storage packs for refilling the storage containers.

11. A method for dosing additives, the method comprising:

providing a dishwashing machine having a washing container for handling of items to be retained and washed;

providing an arrangement that separately stores basic chemical products of an all-round additive product, independent of one another;

providing a dosing device operatively connected to the arrangement, to provide a dose of said additive product to the dishwashing machine; and using the dosing device to selectively dose into the dishwashing machine the additive product in each of the following modes:

1) a first mode of dosing at least a portion of a selected one of at least one basic chemical product of the all-round additive product not used for clear rinsing; 2) a second mode of dosing at least two, but not all, of the basic chemical products of the all-round additive product together; and 3) a third mode of dosing at least one reaction mixture consisting of the basic chemical products of the all-round additive product.

12. The method according to claim 11, wherein the step of dosing into the dishwashing machine an additive product includes dosing in only those basic chemical products or reaction mixtures that are required for a process step using a conveying device.

13. The method according to claim 11, wherein the step of dosing into the dishwashing machine an additive product includes dosing in basic chemical products of an all-round additive product that have been reacted together in a micro-reactor at least partly by a chemical reaction to form a reaction mixture that is a selected one of completely a liquid mixture, completely a gas mixture, and a mixture that is not completely a liquid or a gas.

14. The method according to claim 11, wherein the step of dosing into the dishwashing machine an additive product includes dosing in basic chemical products of an all-round additive product that have been reacted together in a micro-reactor with these basic chemical products being supplied to at least one of the micro-reactor and the washing container in a precisely metered manner by a micro-dosing pump.

15. The method according to claim 11, wherein the step of dosing into the dishwashing machine an additive product includes dosing in an additive product while regulating the addition parameters, time and quantity of the basic chemical products or the reaction mixture for a process step depending on the process steps and/or the actual contamination that is detected automatically using sensors or manually.

* * * * *